US005507385A

United States Patent [19]

Koloski et al.

[11] Patent Number: 5,507,385

[45] Date of Patent: Apr. 16, 1996

[54] MULTIPURPOSE STORAGE BIN

[75] Inventors: Peter A. Koloski, Columbus; Stacy L. Wolff, Akron, both of Ohio

[73] Assignee: Rubbermaid Incorporated, Wooster, Ohio

[21] Appl. No.: 289,093

[22] Filed: Aug. 12, 1994

[51] Int. Cl.[6] ..... B65D 85/28

[52] U.S. Cl. ..... 206/372; 206/373; 220/521; 220/735

[58] Field of Search ..... 206/372, 373, 206/508, 511; 220/315, 322, 521, 523, 555, 735

[56] References Cited

U.S. PATENT DOCUMENTS

| | | | |
|---|---|---|---|
| D. 319,016 | 8/1991 | Kahl | D9/424 |
| 3,791,547 | 2/1974 | Branscum | 220/522 |
| 3,926,308 | 12/1975 | Sullivan | 206/372 |
| 4,523,692 | 6/1985 | Lemkin | 220/306 |
| 4,889,257 | 12/1989 | Steffes . | |
| 4,991,711 | 2/1991 | Cheng | 206/372 |
| 5,125,697 | 6/1992 | Kahl et al. | 220/315 |
| 5,409,126 | 4/1995 | DeMars | 206/508 |
| 5,429,265 | 7/1995 | Maire et al. | 206/372 |

OTHER PUBLICATIONS

Catalog page, Storage containers; Rubbermaid Incorporated, 1147 Akron Road, Wooster, Ohio 44691. Publication date 1991.

Catalog page, Work surfaces; Rubbermaid Incorporated, 1147 Akron Road, Wooster, Ohio 44691. Publication date 1994.

*Primary Examiner*—David T. Fidei

*Attorney, Agent, or Firm*—Richard B. O'Planick; Lisa B. Riedesel

[57] ABSTRACT

A multipurpose storage container is disclosed comprising a lid (14), base (12), and latch handles (16). The lid (14) is configured for positionment upon the base (12) in alternative upright and inverted positions. In the inverted configuration, the lid (14) creates a work surface (46) having integral support grooves (60, 62) for securing a tubular work piece. In the upright configuration, the lid (14) presents domed upper surface (36) that can serve as a seat. The latch handles (16) are pivotally attached to ends of the base (12) and pivot upward to secure the lid to the base in either of the two alternate lid configuration.

16 Claims, 6 Drawing Sheets

MULTIPURPOSE STORAGE BIN

BACKGROUND OF THE INVENTION

1. Field of the Invention

The present invention related generally to plastic storage containers for transporting and storing tools or other general articles and, more specifically, to such containers which dually serve as support surfaces on which to perform work tasks.

2. The Prior Art

Portable plastic storage containers are well known consumer products. They are used for a variety of storage needs, such as the storage of work tools in a garage, or the storage of other household articles. Lightweight and with integral handles, such containers provide a convenient means not only for storing such articles, but also transporting them to remote locations for use. For example, a user may carry a container full of tools from a storage location to a remote location for use.

Typically, conventional storage containers comprise a four sided base, a lid covering the base, and one or more handles, often located at the ends of the base, which are pivotally attached to the base and which pivot up and over the peripheral rim of the lid to secure the lid to the base. U.S. Pat. No. D-319,016 shows a container of this general type; U.S. Pat. No. D-339,471 a lid of the general type; and U.S. Pat. No. 5,125,697 a latch of this general type. As will be noted, the lids of such containers are typically flat or slightly crowned on the top, and have recesses in end portions of the rim to receive the latches in a locking manner.

While such containers function well and are commercially popular, they do not afford the end user maximum utility, and certain significant uses to which the container might be put are not possible with currently available storage container configurations. The user has need, for example, for a means for organizing tools at a work site for more efficient access. A user also typically needs a work surface on which to support work articles such as lumber or pipe. In such circumstances, the user will need to additionally transport sawhorses or portable workbenches to the worksite. The inconvenience of making several trips to a work site when the storage container full of tools and a work surface is required is unavoidable with conventional products.

SUMMARY OF THE INVENTION

The present invention overcomes the aforementioned shortcomings of conventional products by providing a storage container having enhanced versatility and utility to the user. The storage container comprises a four sided container base and a lid member that is positionable upon the upper rim of the base in either one of two ways; in the upright condition for storage and transportation, and in an inverted condition for use of the container as a work surface.

The lid is configured having a peripheral edge flange and elevated top and bottom central portions. In the upright configuration, the bottom elevated central portion registers within the base rim and in the inverted configuration, the top elevated central portion registers. The edge flange of the lid is provided with openings in opposite ends with upper and lower detent sockets formed in each opening. A latch handle is pivotally attached to each end of the base and pivots up and over the detent socket in the lid in both the upright and inverted lid conditions. Thus, the lid can be secured to the base in either condition.

The lid bottom elevated central portion is bordered by uppermost, planar peripheral support surfaces which, with the lid in the inverted condition, serve as work-piece supporting surfaces. Intermediate coplanar support surfaces cooperate with the peripheral support surfaces to support lumber or other material in a level condition for the user. V-shaped grooves are provided in the support surface in co-alignment for supporting tubular work pieces such as pipes.

A storage cavity is formed within the elevated bottom central portion and compartmentalized to allow for segregated organization of work tools or the like. Thus, the user may store larger tools in the base of the container, and smaller hand tools in the lid storage cavity compartments, and simultaneously transport both to a remote work site. The latch handles function as handles with the lid in either the upright or inverted condition on the base. Once at the remote work site, the hand tools in the lid are conveniently accessible and the top of the inverted lid serves as a flat work surface.

Accordingly, it is an objective to provide a storage container having multiple functions and serving the multiple needs of a user for storage of large tools, storage and organization of smaller tools, simultaneous transport to remote work location, and a flat work surface.

A further objective is to provide a storage container having a lid component that is reversible and that latches onto the base in either condition.

Still a further objective is to provide a storage container having a lid that serves as a work surface in the inverted condition and as a container cover in either the upright or inverted conditions.

Yet a further objective is to provide a storage container having a positive latch for locking a lid component to a base component in either an upright or inverted condition.

Another objective is to provide a storage container having multiple functional modes of use and having a minimal number of component pans.

A further objective is to provide a portable multi-purpose storage container and work center which is inexpensive to manufacture and convenient to use.

These and other objectives, which will be apparent to those skilled in the art, are achieved by a preferred embodiment that is described in detail below and illustrated by the accompanying drawings.

DESCRIPTION OF THE ACCOMPANYING DRAWINGS

DESCRIPTION OF THE PREFERRED EMBODIMENT

Figure 1:
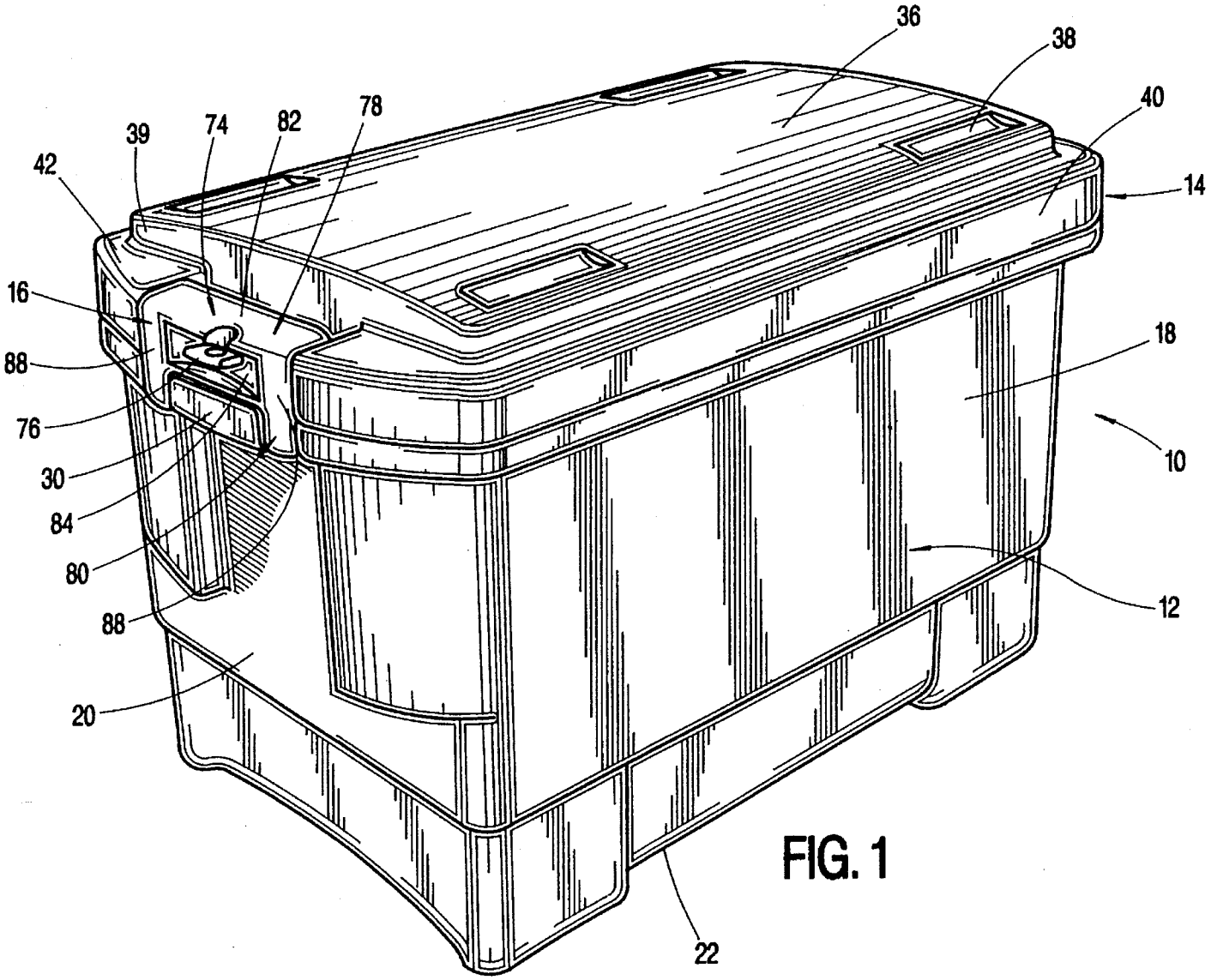
FIG. 1 is a perspective view of the subject container with the lid in the upright condition.

Referring first to FIGS. 1,2,3, and 4, the subject multipurpose container 10 is shown to generally comprise a rectangular base 12, a lid 14, and two latch members 16. The base 12 is molded conventionally from plastic material such as polyethylene, and is configured having four sides 18, two end walls 20, and a bottom 22, with the sides 18 extending vertically upward from the bottom 22 to an upper rim 24. The sides 18 and bottom 22 define an upwardly open storage chamber 26 of sufficient dimension to accommodate the storage of articles such as tools, e.g. saws, planes, sanders, etc.

At each end of the base 12 are vertical and spaced apart flanges 28 which extend outwardly. A handle bar 30 is formed to span the gap between the flanges 28 and is spaced outwardly from the end wall of the container base 12 so as to enable a user to grasp the bars 30 from the bottom and lift the base 12 thereby. The handle bars are molded to provide a smooth, radiussed bottom surface for the comfort and convenience of the user. Apertures 32 are provided in opposite ends of the handle bars 30 for mounting the latch plates as will be explained below. At the bottom four comers of the base 12 are stacking feet 34.

The lid member 14 is molded preferably in conventional fashion out of plastic material such as polyethylene. The lid 14 comprises a central raised, and concave surface 36 having four sockets 38 molded into the corners thereof. The sockets 38 are shaped and dimensioned to receive the stacking feet 34 or another container such that multiple containers may be stacked upon one another in vertical fashion. The concave upper lid surface 36 is bordered by a peripheral edge flange 40, defined by an upper flange surface 42 and a lower peripheral flange surface 44. The flange 40 extends the periphery of the lid 14.

A raised central portion 46 of the underside of the lid 14 is defined by an outer peripheral surface 48. The surface 48 is generally rectangular, planar, and lies in a horizontal plane which is spaced away from the lower surface flange surface 44. A storage cavity 50 extends downward into the raised portion 46 between the peripheral surface 48. The storage cavity 50 terminates at a floor 51. Two partitions 52,54 extend transversely across the cavity 50 and divide the cavity into multiple storage compartments. The top surfaces 56,58 of the partitions 52,54, respectively, are coplanar with the peripheral surfaces 48. Aligned V-shaped grooves 60,62 are provided in surfaces 48, and 56,58, respectively, for a purpose explained below.

Figure 2:
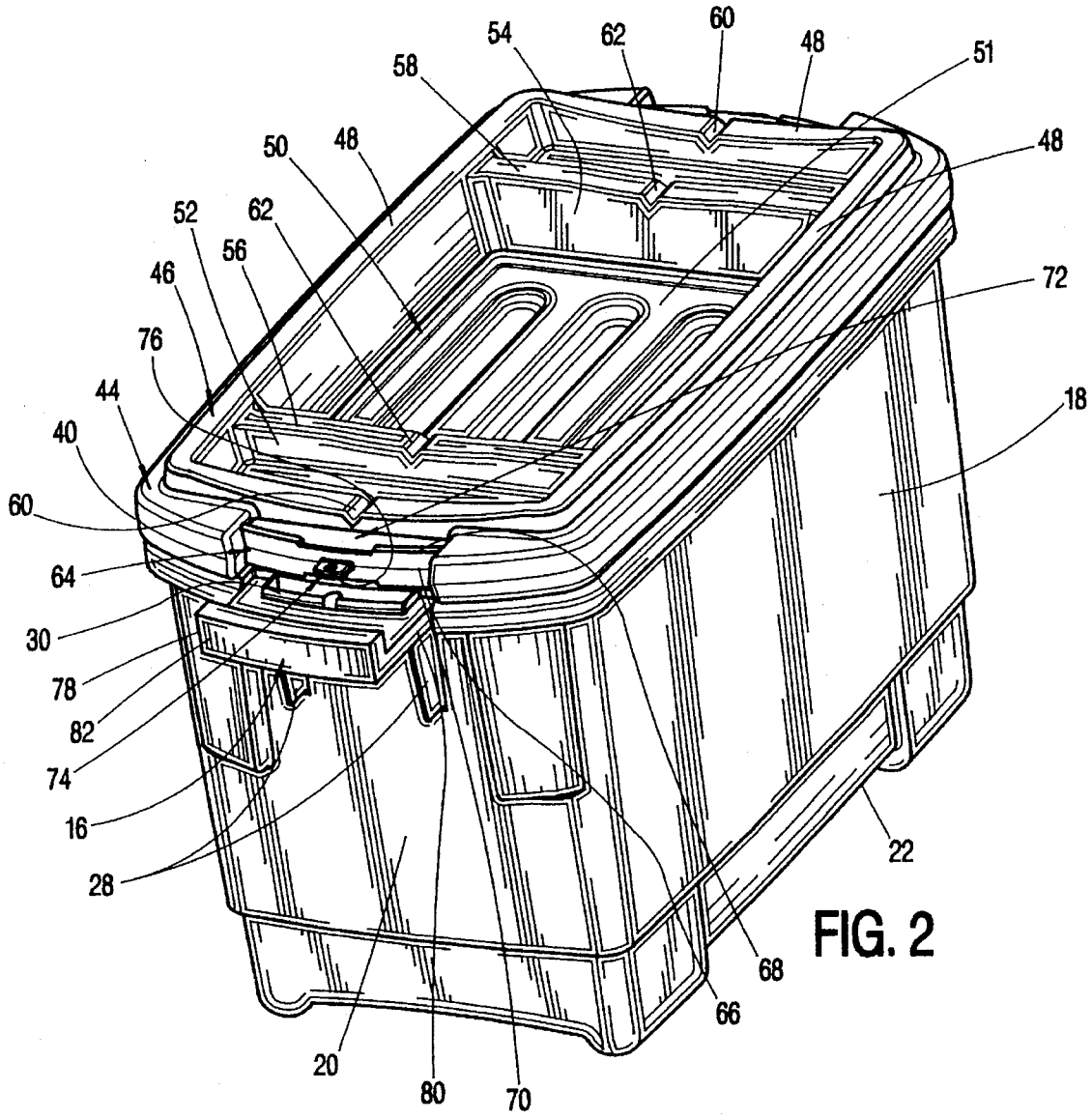
FIG. 2 is a front perspective view of the subject container with the lid in its inverted condition.
Figure 3:
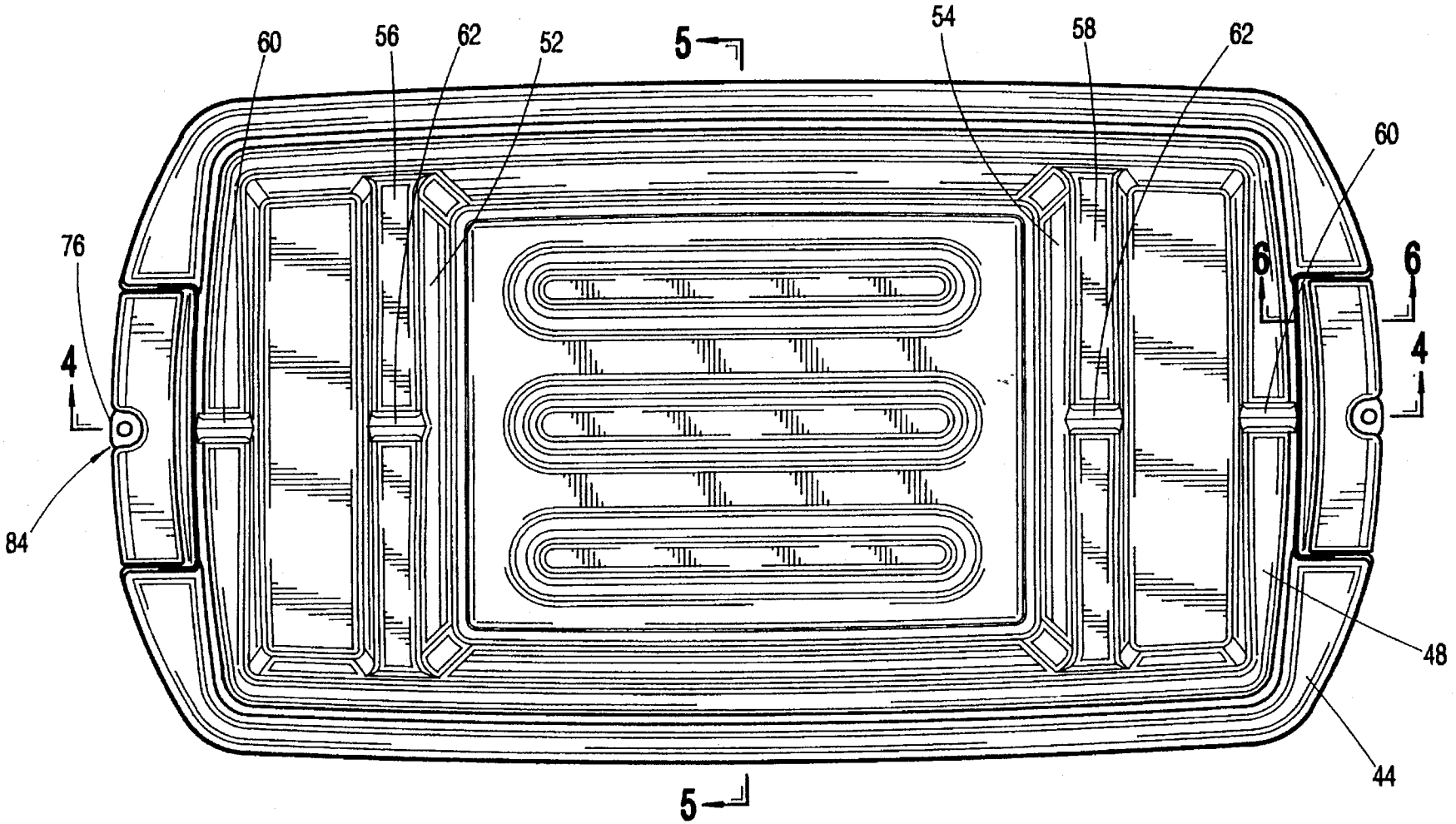
FIG. 3 is a top plan view of the configuration depicted in FIG. 2.
Figure 4:
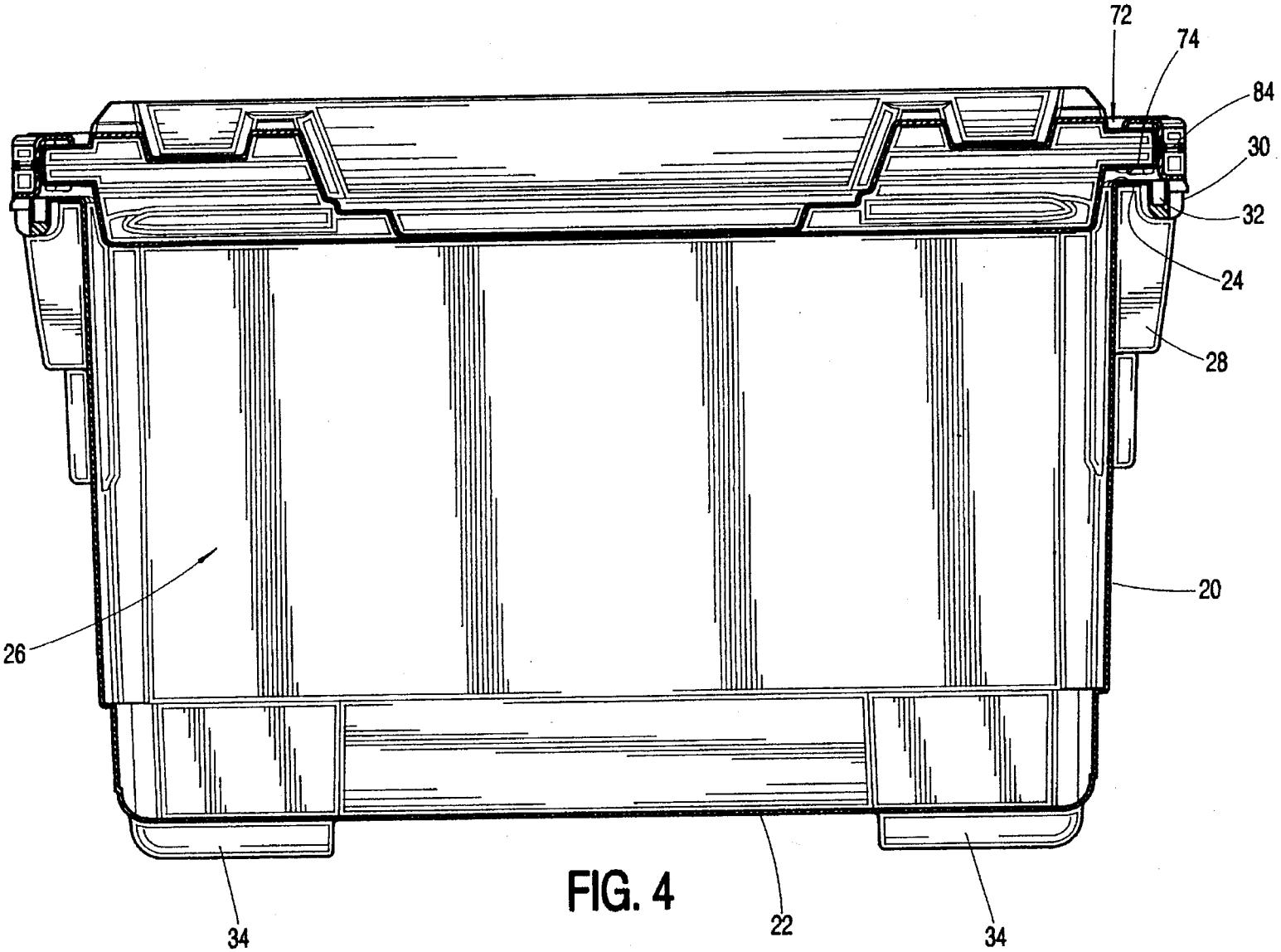
FIG. 4 is a longitudinal section view through the container taken along the line 4—4 of FIG. 3.
Figure 5:
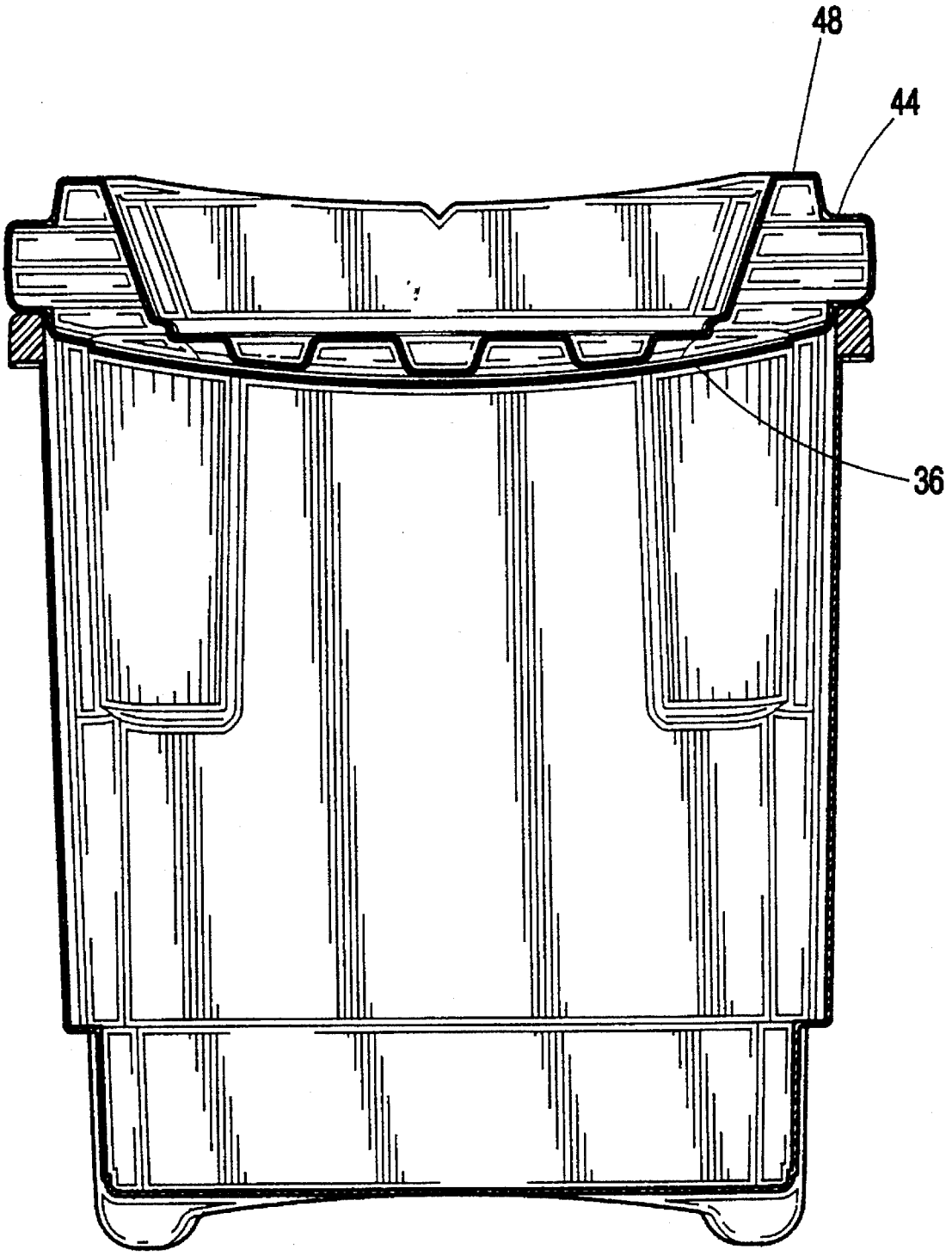
FIG. 5 is a transverse section view through the subject container taken along the line 5—5 of FIG. 3.
Figure 6:
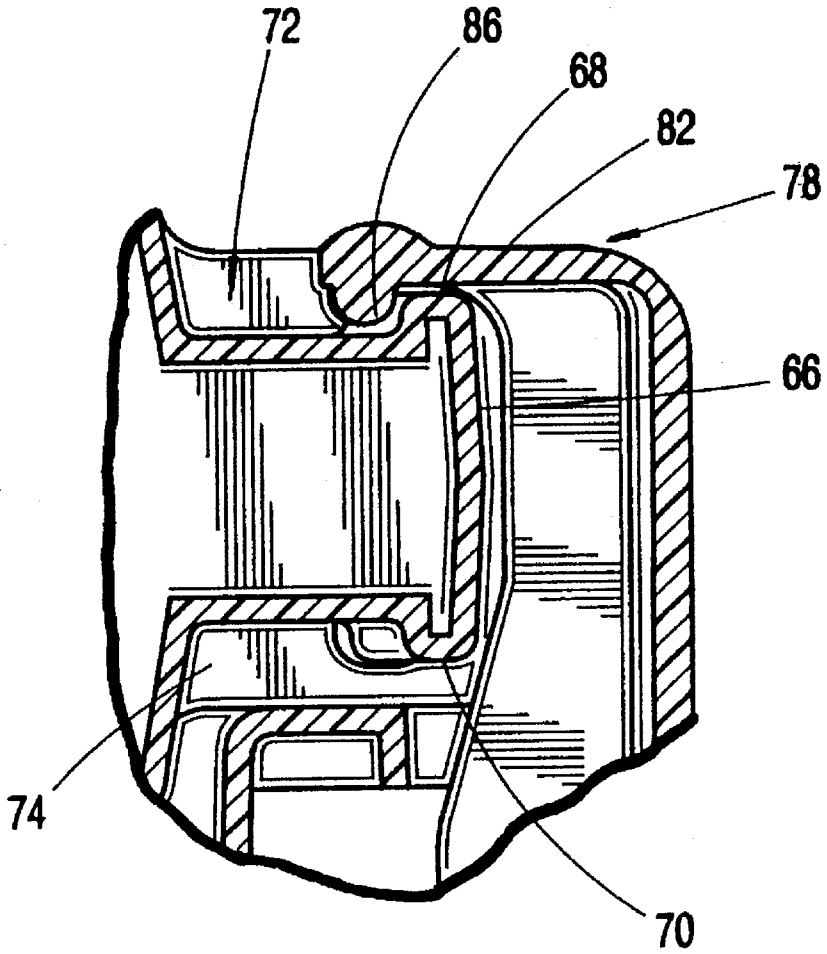
FIG. 6 is a section view through the latch and lid detent structure.

The end portions of the peripheral flange 40 of the lid 14 are each adapted to have a central opening 64, having a width corresponding to the spacing between the vertical flanges 28 of the base 12, and positioned above the handle bar 30. The openings 64 each terminate at a vertically extending wall 66, as best illustrated by FIGS. 2,4, and 6. The walls 66 each are defined by an upper wall edge 68 and a lower wall edge 70. Inward of the walls 66 are upper and lower latching detents 72,74. A locking tab 76 projects outward from the center of each wall 66 in horizontal fashion, each tab 76 having a central through hole.

With continued reference to FIGS. 1,2,4, and 6, the subject latch plates 16 are molded conventionally of plastics material, each having a generally C-shape. The plates 16 have an upper portion 78 and a lower portion 80. The upper portion 78 includes a generally planar uppermost surface 82 and the front face of the latch plates 16 are formed to have a lock tab opening 84 extending therethrough. The forward end of the latch plate upper portion 778 is provided with a downward retention flange 86. The lower portion 80 of each plate 16 comprises spaced apart legs 88, each leg having an inwardly directed molded pin (not shown) that resides in a respective aperture 32 in the ends of the handle bar 30. Thus, the latch plates can pivot upward and downward, toward and away from, the lid which is positioned upon the container base.

From the foregoing, it will be appreciated that the lid component 14 is positionable upon the container base 12 in either an upright condition, represented in FIG. 1, or in an inverted condition depicted in FIGS. 2–5. In the upright condition, the latch plates 16 can be pivoted upward until the retention flange 86 rides over the upper wall edge 68 of the lid 14 and resides in the upper detent 72. The lid is thereby fixed to the base. The base container contains ample room for storage of tools such as electric saws or sanders, and the container may be transported to and from a work site by the user grasping the handle bars 30 and lifting upward. The tab 76 of the lid component projects through the tab opening 84 in the latch plate 16, and a padlock may be inserted through the tab 76 to lock the lid in place.

Alternatively, the lid may be inverted and placed upon the container base. In such a position, as shown in FIGS. 2–5, the storage cavity 50 is exposes and provides a shallow storage chamber for smaller handtools, such as hammers, nails, etc. The partitions 52,54 divide the cavity 50 into sub-compartments for convenience of the user. However, if so desired, the subject lid can be formed to have a single, undivided cavity 50 and the partitions 52,54 eliminated. Or, the cavity 50 can be configured to provide more compartments by the inclusion of more partitions. The compartments, furthermore, can be configured specifically to hold specific tools, such as socket sets, or chisels, or small parts such as nails or screws. Even further, the compartments may be adapted to have individual lids for enclosing such compartments if so desired.

With the lid in its inverted condition, each of the latch plates 16 can also be pivoted toward the lid until the retention flange 86 rides over the lower wall edge 70 (now on top) of the lid 14 and resides in the lower detent 74. The lid in its inverted condition is then fixed to the base and the base container may be transported to and from a work site by the user grasping the handle bars 30 and lifting upward. The tab 76 of the lid is adapted to insert through the tab opening 84 in the latch plate 16 with the lid inverted, making the lid lockable to the base in either condition.

Thus, the container can be used in two different modes. The first is mode is by placing the lid upright and locking it into position. The tools stored in the container base are entirely covered in such a configuration. In the second mode, the lid is inverted and locked to the base. The tools in the base are still entirely covered but the lid then serves as a secondary tool tray, for smaller tools or parts such as nails or screws.

Once a user has arrived at a remote work site, the container and lid serve in a third capacity, as a work surface. With the lid in its inverted condition, the uppermost planar and horizontal surfaces 48,56, and 58 provide a support surface across which a work piece my be extended. The surfaces 48,56, and 58 are uppermost and a work piece will therefore not encounter any interference and may be sawed, drilled, or otherwise machined by the user. Since there is a cavity 50 below the support surfaces 48,56, and 58, a user may nail or drill through a supported work piece and not damage the lid. In addition, since tools can be carried in the bottom of the cavity 50, they are out of the way of the workpiece yet can be quickly and conveniently accessed by the user when needed.

The grooves 60,62 of the lid underside are co-aligned to provide a pipe or tube supporting channel, whereby enabling a user to render such a workpiece motionless. In addition, it will be appreciated that the latch plate top portion 78 is recessed below the peripheral flange lower surface 44 in the locked condition and the peripheral flange lower surface 44 is, in turn, below the plane of the support surfaces 48,56, and 58. Thus, ends of a workpiece supported by the surfaces 48,56, and 58 may be extended over the ends of the lid and not encounter any interference.

While the above describes the preferred embodiment of the subject invention, the subject invention is not intended to be restricted thereto. Other embodiments which will be apparent to those skilled in the art and which utilize the teachings herein set forth are intended to be within the scope and spirit of the invention.

We claim:

1. A portable multi-purpose storage container comprising:

a container base having a bottom, four sidewalls extending upward from the bottom to an upper rim, and an upwardly open storage chamber defined by the bottom and four sidewalls;

a lid member having a top side and an underside and fitting over the container rim in an upright condition to enclose the storage chamber; the lid alternatively being positionable over the container upper rim in an inverted condition so that the lid underside faces upward; and the lid underside having substantially planar uppermost peripheral edge surfaces that lie in a common, horizontal plane whereby, in the inverted condition, the lid bottom edge surfaces serving as a work support surface; and the lid underside having at least one intermediate support surface positioned inward of and extending between the peripheral edge surfaces and also lying within the common horizontal plane.

2. A storage container according to claim 1, wherein the lid underside having at least one partition wall extending between the peripheral edge surfaces and dividing the storage cavity into a plurality of compartments, the intermediate support surface comprising an upper surface of the partition wall.

3. A portable multi-purpose storage container comprising:

a container base having a bottom, four sidewalls extending upward from the bottom to an upper rim, and an upwardly open storage chamber defined by the bottom and four sidewalls;

a lid member having a top side and an underside and fitting over the container rim in an upright condition to enclose the storage chamber; the lid alternatively being positionable over the container upper rim in an inverted condition so that the lid underside faces upward; and the lid underside having substantially planar uppermost peripheral edge surfaces that lie in a common, horizontal plane whereby, in the inverted condition, the lid bottom edge surfaces serving as a work support surface;

latching means for securing the lid member to the base in either the upright or the inverted condition wherein the latching means comprises an edge portion of the lid member configured to have upwardly and downwardly directed detent sockets, and a latch plate member pivotally mounted to the base proximate the upper rim, the latch plate member having a retention flange at a remote end and the latch plate member is pivotal between an open condition away from the lid member and a closed position in which the retention flange resides in an alternative one of the lid member detent sockets.

4. A storage container according to claim 3, wherein the latch plate member having a substantially C-shape, with a lower end portion pivotally coupled to the base member and an upper end portion overlapping the lid member edge portion in the closed position, and the upper end portion is configured to lie at or below the horizontal plane of the lid underside peripheral edge surfaces with the lid in the inverted condition.

5. A storage container according to claim 4, wherein the upward and downward directed detent sockets are defined by a common outward facing wall having upward and downward edges, with the lower edge of the wall positioned below the horizontal plane of the lid peripheral edge portions, and the latch plate member upper end portion overlaps the lower edge of the wall with the lid member positioned in the inverted condition.

6. A portable multi-purpose storage container comprising:

a container base having a bottom, four sidewalls extending upward from the bottom to an upper rim, and an upwardly open storage chamber defined by the bottom and four sidewalls;

a lid member having a top side and an underside and fitting over the container rim in an upright condition to enclose the storage chamber; the lid alternatively being positionable over the container upper rim in an inverted condition so that the lid underside faces upward; and the lid underside having substantially planar uppermost peripheral edge surfaces that lie in a common, horizontal plane whereby, in the inverted condition, the lid bottom edge surfaces serving as a work support surface;

latch means for securing the lid member to the base in either the upright or inverted conditions; and the lid underside having at least one intermediate support surface positioned inward of and extending between the peripheral edge surfaces and also lying within the common horizontal plane.

7. A storage container according to claim 6, wherein the lid having at least one partition wall extending between the peripheral edge surfaces and dividing the storage cavity into a plurality of compartments, the intermediate support surface comprising an upper surface of the partion wall.

8. A storage container according to claim 7, wherein the lid underside surface having aligned V-shaped grooves in the peripheral edge surfaces for receiving and rendering motionless a tubular work-piece.

9. A storage container according to claim 6, wherein the latching means comprises an edge portion of the lid member configured to have upwardly and downwardly directed detent sockets, and a latch plate member pivotally mounted to the base proximate the upper rim, the latch plate member having a retention flange at a remote end and pivots between an open condition away from the lid member and a closed position in which the retention flange resides in an alternative one of the lid member detent sockets.

10. A storage container according to claim 9, wherein the latch plate member having a substantially C-shape, with a lower end portion pivotally coupled to the base member and an upper end portion overlapping the lid member edge portion in the closed position, and the upper end portion is configured to lie at or below the horizontal plane of the lid underside peripheral edge surfaces in the inverted condition.

11. A storage container according to claim 10, wherein the upwardly and downwardly directed detent sockets are defined by a common outward facing wall having upward and downward edges, with the lower edge of the wall positioned below the horizontal plane of the lid peripheral edge portions, and the latch plate member upper end portion overlaps the lower edge of the wall with the lid member positioned in the inverted condition.

12. A portable multi-purpose storage container comprising:

an container base having a bottom, four sidewalls extending upward from the bottom to an upper rim, and an upwardly open storage chamber defined by the bottom and four sidewalls;

an lid member having a top side and an underside and fitting over the container rim in an upright condition to enclose the storage chamber; the lid alternatively being positionable over the container upper rim in an inverted condition so that the lid underside faces upward; and the lid underside having substantially planar uppermost peripheral edge surfaces that lie in a common, horizontal plane whereby, in the inverted condition, the lid bottom edge surfaces serving as a work support surface; and the container further comprising latch means for securing the lid member to the base in either the upright or inverted conditions.

13. A storage container according to claim 12, wherein the latch means comprising upwardly and downwardly opening detents in the lid member edge flange and a latch plate member pivotally mounted to the base proximate to the upper rim, the latch plate member having a retention flange at a remote end and pivots between an open condition away from the lid member and a closed position in which the retention flange resides in an alternative one of the lid member detent sockets.

14. A storage container according to claim 13, wherein the latch plate member having a substantially C-shape, with a lower end portion pivotally coupled to the base member and an upper end portion overlapping the alternative one of the lid member detent sockets, and the upper end portion is configured to lie below the lid member edge flange top and bottom surfaces, alternatively, with the latch plate member in the closed position.

15. A storage container according to claim 13, wherein the lid central elevated bottom portion having a storage cavity extending downward therein between the peripheral support surfaces.

16. A storage container according to claim 15, wherein the lid central elevated bottom portion having at least one partition wall extending between the peripheral edge surfaces and dividing the storage cavity into a plurality of compartments, and a top surface of the partition wall lying in the horizontal plane of the peripheral support surfaces whereby serving to support a work-piece positioned across the peripheral support surfaces.

* * * * *

UNITED STATES PATENT AND TRADEMARK OFFICE

CERTIFICATE OF CORRECTION

PATENT NO. : 5,507,385
DATED : April 16, 1996
INVENTOR(S) : John W. Koenig, Peter A. Koloski, Stacy L. Wolff It is certified that error appears in the above-indentified patent and that said Letters Patent is hereby corrected as shown below:

Cover page, (75), add --John W. Koenig, Columbus-- before "Peter A. Koloski".

Cover page, (75), "both" should read --all--.

Column 2, Line 38, "pans" should read --parts--.

Column 3, Line 19, "comers" should read --corners--.

Column 3, Line 64, "778" should read --78--.

Column 4, Line 56, "my" should read "may".

Signed and Sealed this

First Day of October, 1996

*Attest:*

Bruce Lehman

BRUCE LEHMAN

*Attesting Officer*

*Commissioner of Patents and Trademarks*